United States Patent [19]

Ergaver

[11] 4,335,168

[45] Jun. 15, 1982

[54] HAIR STYLER EXTRUSION

[75] Inventor: Rayko Ergaver, Nassau, The Bahamas

[73] Assignee: Capella Inc., Freeport, The Bahamas

[21] Appl. No.: 181,508

[22] Filed: Aug. 26, 1980

[51] Int. Cl.[3] ..... B32B 1/08

[52] U.S. Cl. ..... 428/36; 132/40; 264/177 R; 428/188

[58] Field of Search ..... 264/177 R; 428/36, 7, 428/188; 138/DIG. 11; 165/179; D28/37, 35; 132/33 B, 40, 42

[56] References Cited

U.S. PATENT DOCUMENTS

| | | | |
|---|---|---|---|
| D. 111,652 | 10/1938 | Gilleland | D28/35 |
| D. 251,205 | 2/1979 | Ergaver et al. | D28/35 |
| D. 251,638 | 4/1979 | Ergaver et al. | D4/35 |
| 2,209,547 | 7/1940 | Whitacre | 428/36 X |
| 2,377,042 | 5/1945 | Rosenthal | 428/36 X |
| 2,577,120 | 12/1951 | Franz | 428/116 X |
| 2,687,997 | 8/1954 | Marchand | 264/177 R X |
| 2,905,447 | 9/1959 | Huet | 165/179 X |
| 3,430,994 | 3/1969 | Keeler | 264/177 R X |
| 3,444,279 | 5/1969 | Dost | 428/36 X |
| 3,508,608 | 4/1970 | Roe | 165/179 |
| 3,738,058 | 6/1973 | Mabuchi | 46/45 X |
| 4,209,043 | 6/1980 | Menzel | 428/188 X |
| 4,271,240 | 6/1981 | Braun | 428/35 X |

*Primary Examiner*—Henry F. Epstein

*Attorney, Agent, or Firm*—Lawrence I. Field

[57] ABSTRACT

An extrusion consisting of a tube having a circular outer cross section, a number of equidistantly spaced, radially extending, elongate ridges around the tube, and a groove between each pair of adjacent ridges.

10 Claims, 8 Drawing Figures

HAIR STYLER EXTRUSION

SUMMARY OF INVENTION

This invention relates to an extrusion for forming a hair styler.

OBJECT OF INVENTION

The object of this invention is the provision of an extrusion for a hair styler which needs very little machining after being formed. The extrusion of this invention consists of a generally cylindrical tube having a plurality of equidistantly spaced, radially extending, elongate ridges around the tube, and a plurality of grooves, one groove being between each adjacent pair of ridges.

DESCRIPTION OF DRAWINGS

The invention will now be described with reference to the attached drawings in which.

DETAILED DESCRIPTION OF PREFERRED EMBODIMENTS

Figure 1:
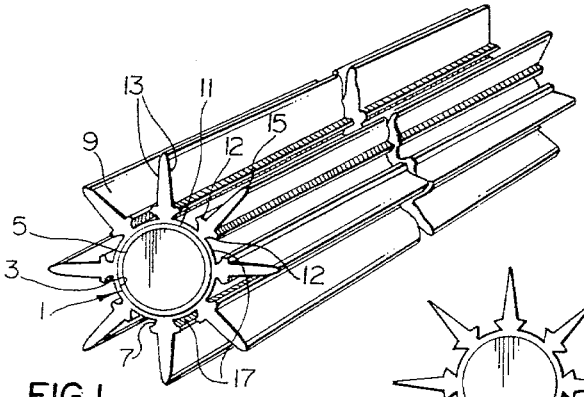
FIG. 1 is an isometric view of an embodiment of the extrusion of this invention.

Referring to FIG. 1, the extrusion consists of a tubular part 1 having a wall 5, defining a cylindrical aperture 3 and having a cylindrical outer surface 7. Extending radially from the outer cylindrical wall 7 are a number of equidistantly spaced ridges 9, each having a base 11, outwardly and circumferentially extending ridge projections 12 from each side of the base 11, and a pair of convergent walls 13 ending in a point 15. The projections 12, together with adjacent projections from an adjacent ridge form grooves 17 having a somewhat dove-tail shape configuration.

FIGS. 2 through 7 show variations of the basic configuration as shown in FIG. 1, there being differences in the shape of the ridges 9 and the shape of the grooves 17.

Figure 2:
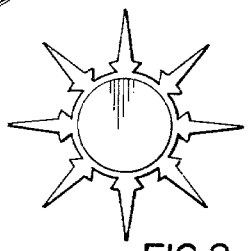
FIG. 2 is a cross-sectional view of a variation of the extrusion of FIG. 1.
Figure 3:
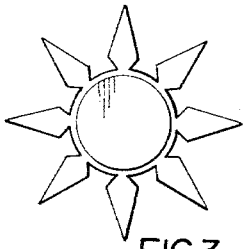
FIG. 3 is a cross-sectional view of a variation of the extrusion of FIG. 1.
Figure 4:
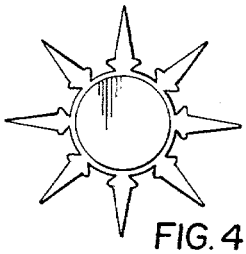
FIG. 4 is a cross-sectional view of a variation of the extrusion of FIG. 1.
Figure 5:
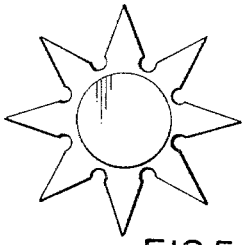
FIG. 5 is a cross-sectional view of a variation of the extrusion of FIG. 1.
Figure 6:
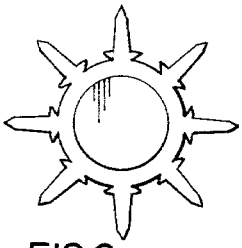
FIG. 6 is a cross-sectional view of a variation of the extrusion of FIG. 1.
Figure 7:
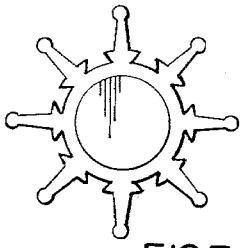
FIG. 7 is a cross-sectional view of a variation of the extrusion of FIG. 1.
Figure 8:
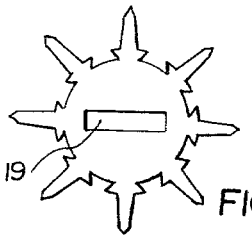
FIG. 8 is a cross-sectional view of a variation of the extrusion of FIG. 1.

FIG. 8 shows a similar type of ridge and groove shape as that shown in FIG. 2, but however, shows a substantially solid cylindrical central section, having a rectangular slot 19 therethrough, rather than the cylindrical aperture defined by wall 5 in FIG. 1.

Although a number of different shapes of ridges and grooves have been shown in the Figures, it is understood that modifications in the shape of the ridges 9 and grooves 17 can be made under the general teachings of this invention, as long as the ridges 9 are generally radially extending and the grooves are formed between the ridges.

The embodiments of the invention in which an exclusive property or privilege is claimed are defined as follows:

1. An extrusion forming a hair styler consisting of a generally cylindrical tube having a circular outer cross section, a plurality of radially, outwardly extending elongate ridges spaced equidistantly around the tube and extending longitudinally along the tube, the base of each ridge being integral with the tube, and a groove between each pair of adjacent ridges, each groove being formed between ridge projections extending transversely from adjacent sides of adjacent ridges and spaced from and adjacent to said base, said ridge projections each being defined by a pair of walls extending outwardly from the respective ridge.

2. The extrusion of claim 1, wherein the facing ridge projections of adjacent ridges together form the groove between the adjacent ridges.

3. The extrusion of claim 1, wherein the extending walls extend from the ends of the ridge projections.

4. The extrusion of claim 1, wherein the extending walls extend from a location inward from the ends of the ridge projections.

5. The extrusion of claims 1, wherein the radially outer ends of the extending walls meet in a point.

6. The extrusion of claims 1, wherein the radially outer ends of the extending walls meet in a rounded end.

7. The extrusion of claims 3 or 4, wherein the radially outer ends of the extending walls meet in a point.

8. The extrusion of claims 3 or 4, wherein the radially outer ends of the extending walls meet in a rounded end.

9. The extrusion of claims 1, wherein the tube has a central, longitudinal aperture of circular cross section.

10. The extrusion of claims 1, wherein the tube includes a central, longitudinal aperture of rectangular cross section.

* * * * *